US006786715B1

(12) United States Patent
Saito

(10) Patent No.: US 6,786,715 B1
(45) Date of Patent: Sep. 7, 2004

(54) GAS LIGHTER

(75) Inventor: Masaki Saito, Shizuoka-ken (JP)

(73) Assignee: Tokai Corporation, Tokyo (JP)

( * ) Notice: Subject to any disclaimer, the term of this patent is extended or adjusted under 35 U.S.C. 154(b) by 0 days.

(21) Appl. No.: 10/381,217

(22) PCT Filed: Oct. 2, 2000

(86) PCT No.: PCT/JP00/06822

§ 371 (c)(1),
(2), (4) Date: Mar. 21, 2003

(87) PCT Pub. No.: WO02/29327

PCT Pub. Date: Apr. 11, 2002

(51) Int. Cl.[7] ..... F23D 11/36
(52) U.S. Cl. ..... 431/153; 431/277
(58) Field of Search ..... 431/153, 277

(56) References Cited

U.S. PATENT DOCUMENTS

| | | | | |
|---|---|---|---|---|
| 5,165,885 A | | 11/1992 | Iwahori | 431/153 |
| 5,197,870 A | | 3/1993 | Yang | 431/153 |
| 5,490,773 A | | 2/1996 | Lloveras Capilla | 431/153 |
| 5,634,787 A | | 6/1997 | Frigiere | 431/153 |
| 5,676,537 A | * | 10/1997 | Fang | 431/153 |
| 5,743,725 A | | 4/1998 | Chan | 431/153 |
| 5,769,625 A | * | 6/1998 | Sher | 431/153 |
| 5,971,748 A | * | 10/1999 | Rogelet | 431/153 |
| 6,099,296 A | * | 8/2000 | Wang | 431/153 |

FOREIGN PATENT DOCUMENTS

| | | | |
|---|---|---|---|
| JP | 518614 | | 5/1993 |
| JP | 08-35660 | * | 2/1996 |
| JP | 179852 | | 6/2000 |
| JP | 2000-179852 | * | 6/2000 |

* cited by examiner

*Primary Examiner*—Carl D. Price
(74) *Attorney, Agent, or Firm*—Baker Botts LLP

(57) ABSTRACT

A gas lighter in which the lighter is locked not to be accidentally ignited by preventing rotation of the side wheel and the lock can be released by an action which can be included in a series of the igniting actions of operating the side wheel to rotate the file wheel to generate a spark and depressing the actuator lever to eject the fuel gas so that even a large-handed person can be easily operate the gas lighter. The ignition means comprises a file wheel, a pair of side wheels fixed to the opposite faces of the file wheel to be rotated integrally therewith and a flint which is in abutment against a lower portion of the file wheel. The rotary shaft of the side wheels are supported for rotation and movement in a direction in which the flint is retracted. An engagement projection formed on the periphery of the side wheels is engaged with an engagement portion on a cap to prevent rotation of the file wheel, thereby locking the lighter not to be ignited. The engagement projection is disengaged from the engagement portion in response to movement of the side wheels in the direction in which the flint is retracted, thereby releasing lock of the lighter.

4 Claims, 6 Drawing Sheets

GAS LIGHTER

TECHNICAL FIELD

This invention relates to a gas lighter in which the fuel gas is ejected and ignited in response to rotation of a side wheel (to rotate a file wheel) and depression of an actuator lever and in which ignition is prevented when the side wheel is in the normal position.

BACKGROUND ART

As disclosed, for instance, in U.S. Pat. Nos. 5,197,870, 5,165,885, 5,634,787 and 5,490,773, there has been known a flint-type gas lighter in which the actuator lever which is depressed to lift the ejector nozzle and cause the nozzle to eject the fuel gas is arranged to be able to cause the nozzle to eject the fuel gas only when it is depressed while being slid.

There have been further proposed various gas lighters which are arranged not to be ignited by simply rotating the side wheel and depressing the actuator lever.

However, almost all the gas lighters provided with a lock mechanism for preventing ignition by the known igniting action is arranged so that the actuator lever cannot be depressed until the lock mechanism is released or until the actuator lever is moved forward, that is, in any one of the known gas lighters provided with an ignition lock mechanism, a small member must be operated to release the lock mechanism. Accordingly, it has been difficult for persons with a large hands to ignite the gas lighters releasing the lock mechanism and it has been demand for improving the structure of such a gas lighter toward practicability.

In other words, in a gas lighter having a lock mechanism which is to be released by an action deviated from the igniting action of operating the side wheel and the actuator lever in this order, the lock release action is troublesome and the ease of operating the light is deteriorated, and at the same time, the gas lighter is complicated in its structure.

In view of the foregoing observations and description, the primary object of the present invention is to provide a gas lighter in which the lock mechanism for preventing accidental ignition of the gas lighter can be released by an action which can be included in a series of the igniting actions of operating the side wheel to rotate the file wheel to generate a spark and depressing the actuator lever to eject the fuel gas so that even a large-handed person can be easily operate the gas lighter.

DISCLOSURE OF INVENTION

In accordance with the present invention, there is provided a gas lighter comprising a lighter body in which fuel gas is stored, a fuel supply mechanism which supplies the fuel gas in the lighter body to a nozzle by way of a valve mechanism, an actuator lever which is provided with a nozzle engagement portion to be engaged with the nozzle to cause the nozzle to eject the fuel gas in response to depression of a depressing portion, an ignition means comprising a file wheel provided with a side wheel on each side thereof and a flint pressed against the file wheel to generate a spark upon rotation of the file wheel and to ignite the fuel gas generated through the nozzle, and a cap mounted on an upper portion of the lighter body, wherein the improvement comprises that the side wheel and the file wheel are supported on a support column so that their axes of rotation are rotatable and movable in a direction in which the flint is retracted, and an engagement projection is provided on the periphery of the side wheel so that the engagement projection on the periphery of the side wheel is engaged with an engagement portion provided on the cap to prevent rotation of the file wheel, thereby locking the lighter not to be ignited, and is disengaged from the engagement portion upon movement of the side wheel in the direction in which the flint is retracted, thereby allowing the side wheel to rotate and releasing lock of the lighter.

Generally, the side wheels are mounted on a rotary shaft which is supported by a vertical bearing hole provided in a support column on the lighter body so that the rotary shaft is rotatable and movable in a direction in which the flint is retracted.

The side wheels may be mounted on a rotary shaft which is elliptical in cross-section and is supported by a bearing hole provided in a support column which is provided on the lighter body to extend vertically and is provided with a slant surface in a lower portion thereof so that the rotary shaft of the side wheel is rotatable and movable in a direction in which the flint is retracted, and is moved upward upon rotation thereof. In this case, a projection may be provided in the bearing hole to resist the rotary shaft of the side wheel being moved in the direction in which the flint is retracted.

Preferably, the engagement projection is provided on the periphery of the side wheel in a plurality of positions substantially at regular intervals and the periphery of the side wheel is provided with a knurled finger-application portion at least forward of each engagement projection in the direction in which the side wheel is rotated upon ignition with the rest part left smooth. It is preferred that side wheel be provided with a pair of engagement projections.

In the gas lighter in accordance with the present invention having a structure described above, the gas lighter can be locked not to be ignited by engaging the engagement projection on the periphery of the side wall with the engagement portion of the cap so that the side wheel cannot be rotated and the lock of the gas lighter can be released by moving the side wheel to retract the flint, thereby disengaging the side wheel from the cap. Accordingly, the gas lighter cannot be rotated by simply rotating the side wheel as in the conventional igniting action, which causes the user to recognize that the gas lighter cannot be ignited by the conventional igniting action. However, this ignition lock can be released by moving the side wheel to retract the flint, which is an action which can be easily done in a series of the igniting actions by even a large-handed person.

When the side wheel is released from the user's finger in a series of the igniting actions and the actuator lever comes to be depressed, the side wheel is automatically returned to the original position under the resilient force of the flint, where the engagement projection of the side wheel can be surely engaged with the engagement portion of the cap to lock the lighter not to be accidentally ignited.

When the side wheels are mounted on a rotary shaft which is supported by a vertical bearing hole provided in a support column on the lighter body so that the rotary shaft is rotatable and movable in the direction in which the flint is retracted, less additional components are required and the structure of the lighter is less complicated, which makes the lighter more suitable for mass production.

Further, when the side wheels are mounted on a rotary shaft which is elliptical in cross-section and is supported by a bearing hole provided in a support column which is provided on the lighter body to extend vertically and is provided with a slant surface in a lower portion thereof so that the rotary shaft of the side wheel is rotatable and movable in the direction in which the flint is retracted, and is moved upward upon rotation thereof, the engagement projection of the side wheel can be surely engaged with the engagement portion of the cap after each igniting action. Especially when a projection is provided in the bearing hole to resist the rotary shaft of the side wheel being moved in the direction in which the flint is retracted, a strong force is required to move the side wheel in the direction in which the flint is pushed downward, which ensures the ignition lock function after a long use of the lighter.

When the engagement projection is provided on the periphery of the side wheel in a plurality of positions substantially at regular intervals and the periphery of the side wheel is provided with a knurled finger-application portion at least forward of each engagement projection in the direction in which the side wheel is rotated upon ignition with the rest part left smooth, the user performs the igniting action with his or her finger applied not to the smooth portion but to the knurled finger-application portion facing upward, the side wheels can be rotated by an angle suitable to bring one of the engaging projections on the side wheel into engagement with the engagement portion on the cap by the time the finger comes to depress the actuator lever, whereby the lighter is surely locked in response to end the of use of the lighter. It is preferred that side wheel be provided with a pair of engagement projections so that the side wheels are rotated by about 180° each ignition action in view of the fact that a suitable amount of spark for ignition can be generated by rotating the file wheel by about 180°.

BEST MODE OF CARRYING OUT THE INVENTION

Gas lighters in accordance with embodiments of the present invention will be described in detail with reference to the drawings, hereinbelow.

First Embodiment

Figure 1:
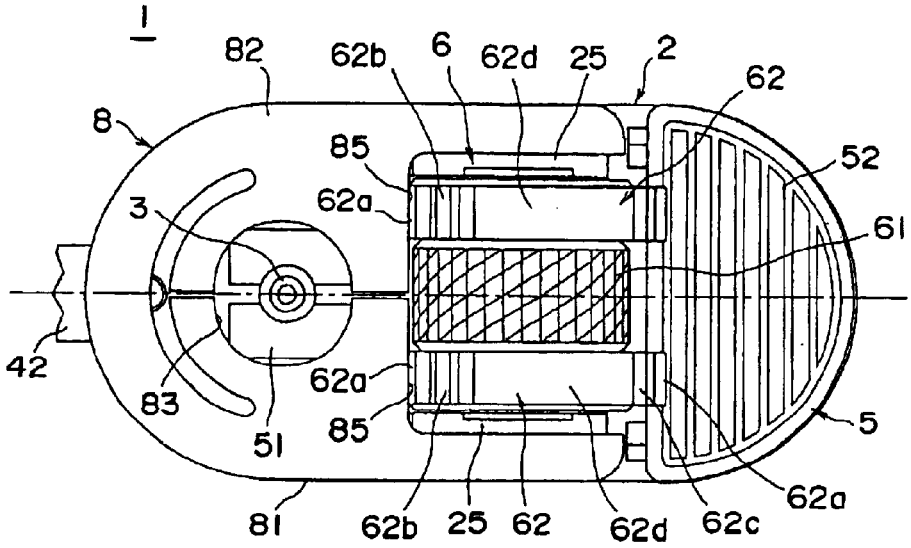
FIG. 1 is a plan view showing a gas lighter in accordance with a first embodiment of the present invention.
Figure 2:
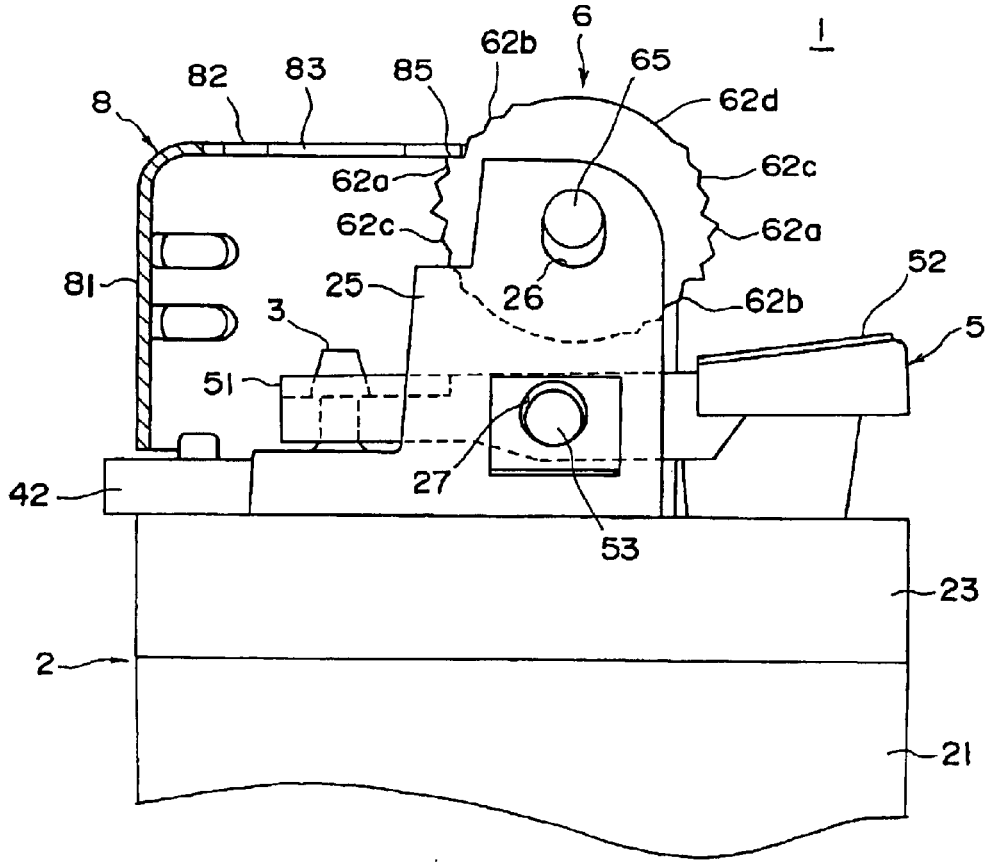
FIG. 2 is a fragmentary front view showing an important part of the lighter shown in FIG. 1 with the cap shown in cross-section.
Figure 3:
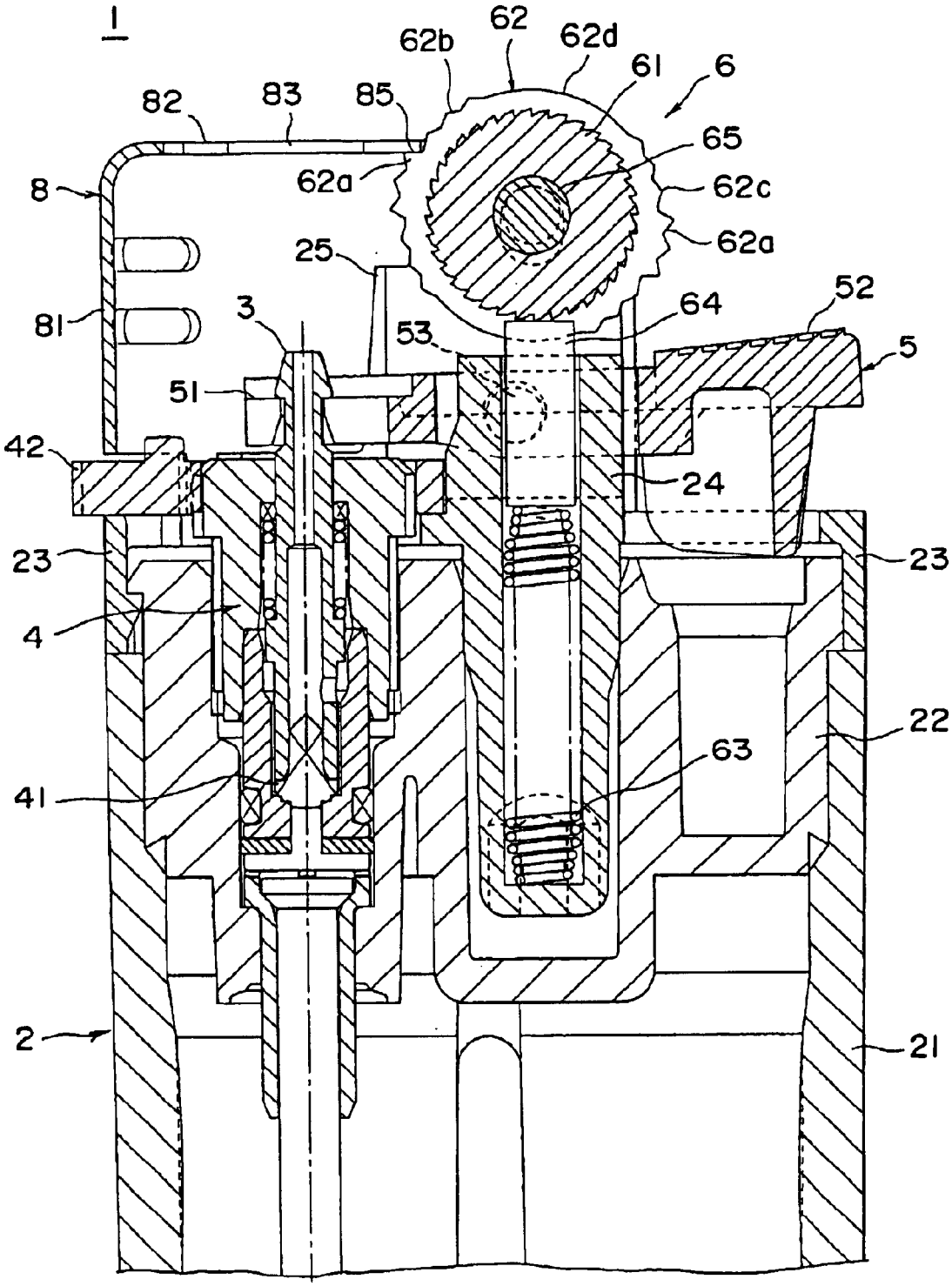
FIG. 3 is a vertical cross-sectional view of the lighter of FIG. 1.

FIG. 1 is a plan viewing showing a gas lighter in accordance with a first embodiment of the present invention in a state where it is not used, FIG. 2 is a fragmentary front view partly in cross-section of the lighter, and FIG. 3 is a vertical cross-section view of the lighter. In the following description, the left in FIG. 1 will be expressed as the front of the lighter, the right will be expressed as the rear of the lighter and the up-and-down direction will be expressed as the left and right direction.

The gas lighter 1 of this embodiment comprises a lighter body 2 in which fuel gas is stored, a fuel supply means 4 comprising a nozzle 3 through which fuel gas is ejected and a valve mechanism 41, an actuator lever 5 which lifts the nozzle 3 to open the valve mechanism 41, and file-type ignition means 6.

The lighter body 2 comprises a bottomed tubular reservoir body 21 formed of synthetic resin and an upper lid 22 air-tightly fixed to the upper side of the reservoir body so that a reservoir in which fuel gas is stored is formed therebetween. An intermediate casing 23 is fitted on the upper lid 22 separately from the reservoir. The intermediate casing 23 is provided at its central portion with a bottomed tubular portion 24 (FIG. 3) which extends in the vertical direction and houses a flit 64 to be described later. A pair of support columns 25 extend upward from the top surface of the intermediate casing 23 on the left and right sides of the tubular portion 24.

The fuel supply means 4 having a known valve mechanism 41 for regulating the amount of the fuel gas to be ejected is disposed in the upper lid 22. The nozzle 3 disposed at the center of the valve mechanism 41 projects upward beyond the intermediate casing 23. The nozzle engagement portion 51 formed on one end of the actuator lever 5 is in engagement with the nozzle 3. The valve mechanism 41 is provided with a flame regulator ring 42 for regulating the amount of fuel gas to be ejected through the nozzle 3.

A cap 8 is mounted on the intermediate casing 23 to surround the nozzle 3 and cover the outer side faces of the left and right support columns 25. The cap 8 is formed by press molding of a metal plate and comprises a peripheral wall portion 81 open at the rear side thereof and a top wall portion 82 defining a top wall. The rear end portions of the peripheral wall portion 81 of the cap 8 are resiliently urged toward each other and resiliently fitted on the support columns 25 not to be moved upward. A flame port 83 is formed in the top wall portion 82 above the nozzle 3 and the inner surface of the rear end portion of the top wall portion 82 is formed into an engagement portion 85 to be described later.

The ignition means 6 comprises a file wheel 61, a pair of side wheels 62 fixed to the opposite faces of the file wheel 61 to be rotated integrally therewith and a flint 64 which is in abutment against a lower portion of the file wheel 61 under the resiliency of a spring 63. The spring 63 is received in the tubular portion 24 of the intermediate casing 23 and the flint 64 is received in the tubular portion 24 above the spring 63 to be projected beyond and retracted from the upper edge of the tubular portion 24.

The opposite end portions of a rotary shaft 65 projects outward through the center of the respective side faces of the side wheels 62 and are respectively received in bearing holes 26 formed in the left and right support columns 25 to be long in the vertical direction so that the side wheels 62 and the file wheel 61 are rotatable about the rotary shaft 65 and movable in a direction perpendicular to the rotary shaft 65 in which the flint 64 is pushed into the tubular portion 24. With this arrangement, a spark is generated upon rotation of the file wheel 61 and the side wheels 62 are urged upward by the spring 63 by way of the flint 64.

Figure 5:
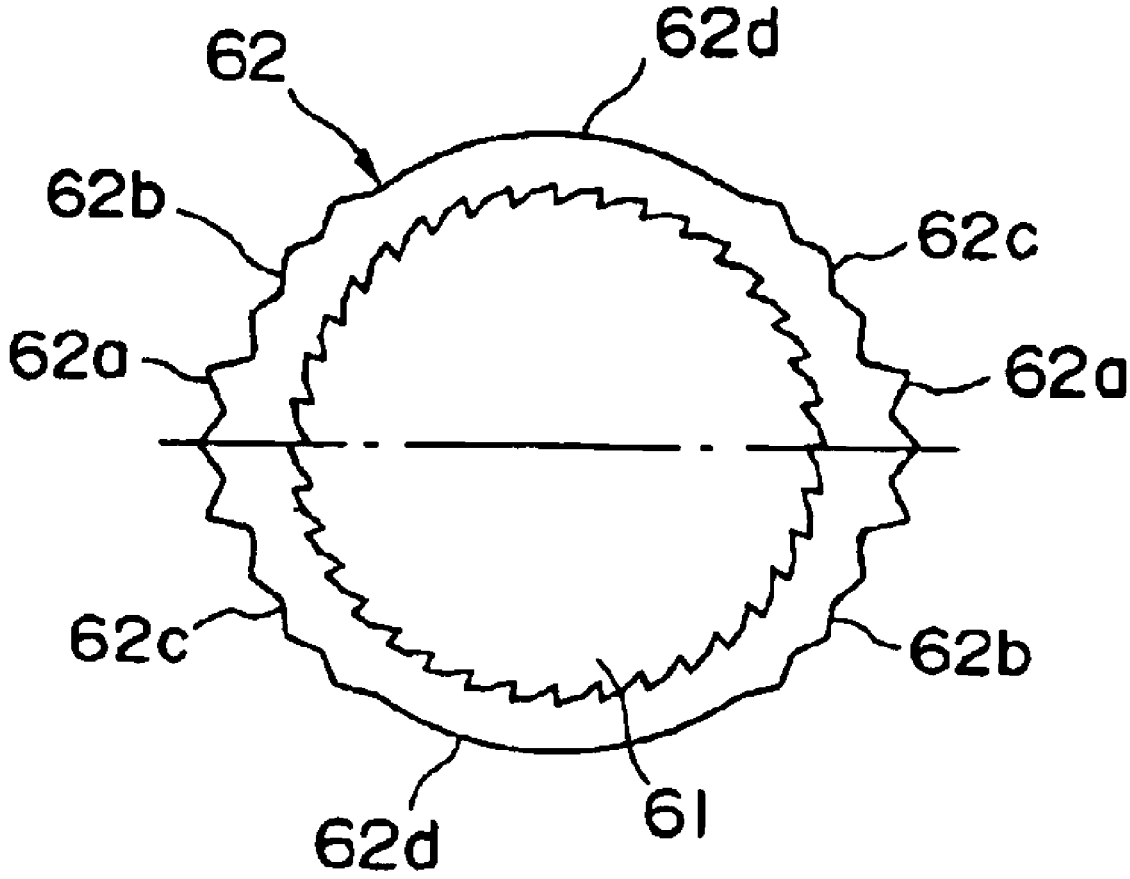
FIG. 5 is a fragmentary front view showing the appearance of the side wheel and the file wheel in the lighter of the first embodiment.

As shown in FIG. 5, each of the side wheels 62 is provided with a pair of engagement projections 62*a* to project radially outward from the periphery of the side wheel 62 in positions spaced from each other by about 180°. Each of the engagement projections 62*a* is brought into engagement with the engagement portion 85 on the top wall portion 82 of the cap 8 to prevent rotation of the side wheels 62 in the igniting direction. The periphery of the side wheel 62 is further provided with knurled finger-application portions 62*b* and 62*c* on front and rear sides of each engagement projection 62*a* in the direction of rotation of the side wheel 62. The part of the periphery of the side wheel 62 between the finger-application portion 62*b* formed on the front side of an engagement projection 62*a* and the finger-application portion 62*c* formed on the rear side of the other engagement projection 62*a* is left smooth to form a smooth portion 62*d*. The outer periphery of each engagement projection 62*a* is also knurled. The left and right side wheels 62 are the same in shape and are mounted on the rotary shaft 65 in the same angular phase.

Each of the front finger-application portions 62*b* is formed over an area of the periphery of the side wheel 62 such that it is exposed upward from the end of the cap 8 so that the side wheel 62 can be moved downward in a state shown in FIGS. 2 and 3 where the engagement projection 62*a* is in engagement with the engagement portion 85 of the cap 8 and the wheel 62 is rotated by about 180° before the finger comes to depress a depressing portion 52 of the actuator lever 5. The angle by which the side wheel 62 is rotated before the finger comes to depress a depressing portion 52 of the actuator lever 5 depends upon the relation between the area over which the front finger-application portion 62*b* is formed and the level of the depressing portion 52 of the actuator lever 5.

Though the finger-application portions 62*b* and 62*c* on the front and rear sides of the engagement projections 62 are the same in shape and the side wheel 62 is symmetrical in the illustrated side wheel, the front and rear sides of the engagement projections 62 may be different in shape and the rear engagement projections 62 may be eliminated. This holds true also for the second embodiment described later.

The actuator lever 5 extends back and forth above the intermediate casing 23 of the lighter body 2 between the support columns 25. The actuator lever 5 is of synthetic resin, and a nozzle engagement portion 51 is formed on one end of the actuator lever 5 and the depressing portion 52 is formed on the other end of the same. The nozzle engagement portion 51 is provided with a slit which is engaged with a neck of the nozzle 3.

The actuator lever 5 is provided with a pair of support shafts 53 extending outward from the respective side faces thereof at the middle thereof. Each support shaft 35 is inserted into a support hole 27 formed in a lower portion of the support column 25, whereby the actuator lever 5 is supported for rotation on the support columns 25. An opening is formed in an intermediate portion of the actuator lever 5 between the nozzle engagement portion 51 and the depressing portion 52 so that the upper end portion of the tubular portion 24 extends upward through the opening. (See FIG. 3)

Operation of the gas lighter 1 of this embodiment will be described, hereinbelow. In the unused state shown in FIGS. 2 and 3, one of the engagement projections 62*a* on the periphery of the side wall 62 in the lifted position is in engagement with the engagement portion 85 on the lower surface of the end portion of the cap 8 and the side wheels 62 cannot be rotated in the igniting direction. That is, the lighter 1 cannot be ignited by rotation of the file wheel 61 in this state, whereby that the gas lighter 1 cannot be used in the known manner can be recognized by the user.

The igniting action of this gas lighter 1 includes depression of the finger-application portion 62*b* in the vicinity of the end of the cap 8 overcoming the force of the spring 63. As the side wheels 62 are moved downward, the engagement projection 62*a* is moved downward away from the engagement portion 85 of the cap 8 and the lighter 1 is brought to a lock-released state where the engagement projection 62*a* of the side wheel 62 does not interfere with the engagement portion 85 of the cap 8 and rotation of the side wheels 62 is allowed.

Then when the side wheels 62 (and accordingly the file wheel 61) are rotated and the depressing portion 52 of the actuator lever 5 is depressed downward, the actuator lever 5 is rotated about the support shafts 53 and lifts the nozzle 3 by way of its nozzle engagement portion 51, whereby fuel gas ejected through the nozzle 3 is ignited by a spark generated by rotation of the file wheel 61.

Though it is possible to depress the side wheels 62 by applying a finger to a smooth portion 62*d* of the side wheel 62, it is impossible to rotate the side wheels 62 since the contact resistance between the file wheel 61 and the flint 64 is large. That is, the finger will slide along the smooth portion 62*d* and will fail in rotating the side wheels 62 to ignite the lighter 1. When the side wheel 62 is released from the finger, the side wheels 62 returns to the lifted position. That is, the smooth portions 62*d* are formed so that the side wheels 62 cannot be rotated unless the finger is applied to the finger-application portion 62*b*.

Figure 4:
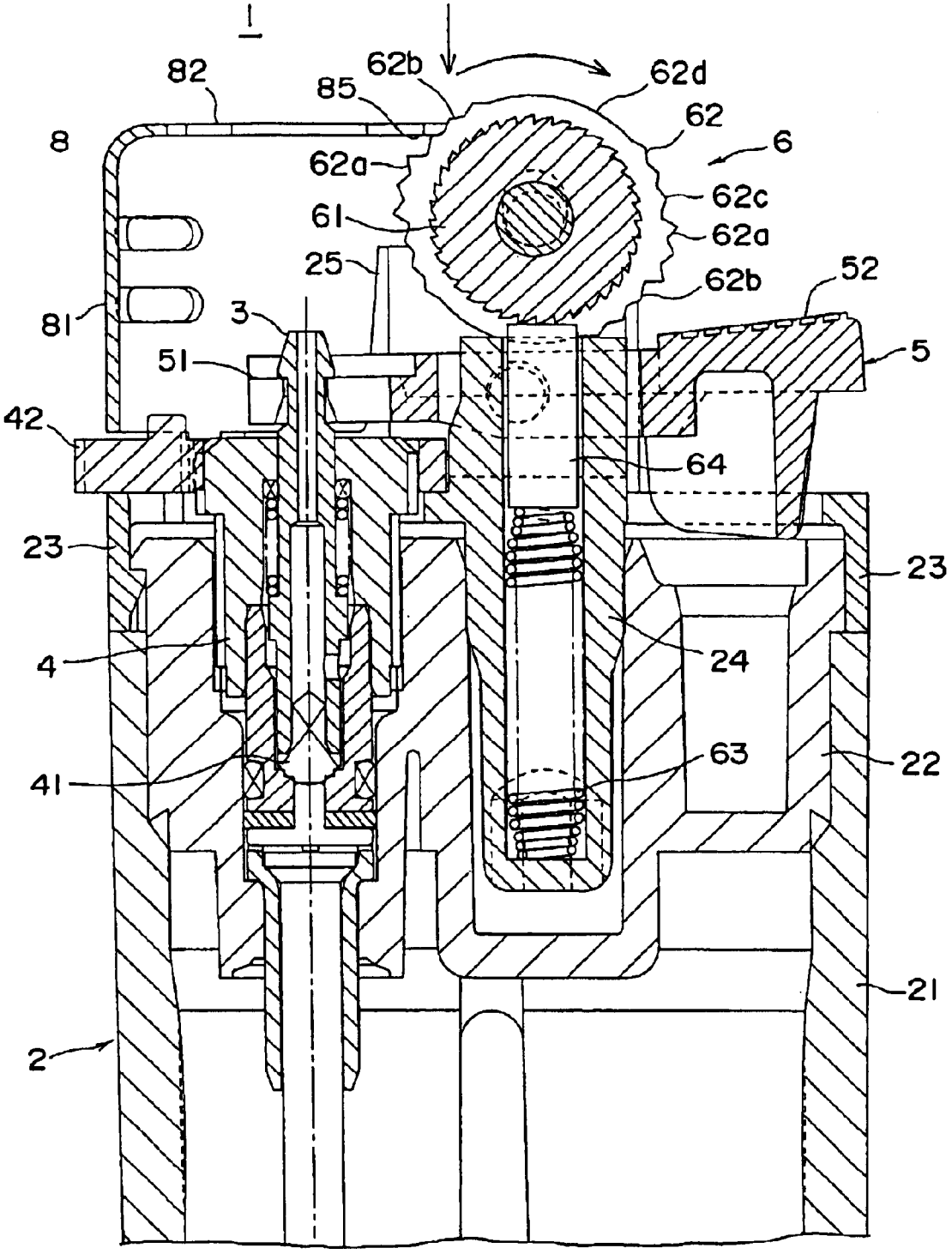
FIG. 4 is a vertical cross-sectional view of the lighter of FIG. 1 showing a state in the course of ignition of the lighter.

During the side wheel rotating action, the user's finger is initially brought into contact with an area extending from a part of the finger-application portion 62*b* to a part of the top face 82 of the cap 8 and comes to contact with a part of the engagement projection 62*a* and the rear finger application portion 62*c* in response to the following depression and rotation of the side wheels 62, and the side wheels 62 are rotated by about 180° where another finger-application portion 62*b* is brought into engagement with the engagement portion 85 of the cap 8 as shown in FIG. 4 by the time the finger is moved away from the side wheels 62 onto the depressing portion 52 of the actuator lever 5.

The side wheels 62 moved downward are lifted, in response to upward movement of the flint 64, under the force of the spring to automatically return to the lock position shown in FIGS. 2 and 3 after the finger is transferred from the side wheel 62 to the actuator lever 5. Even if the side wheel 62 is rotated by an angle slightly larger or smaller than 180°, the engagement projection 62*a* on the side wheel 62 and the engagement portion 85 on the cap 8 can be engaged to lock ignition of the lighter 1. When the depressing portion 52 of the actuator lever 5 is released from the finger, the nozzle 3 is moved downward under the force of a spring disposed in the fuel supply means 4 and ejection of fuel gas is stopped whereby the lighter 1 is quenched.

In the lighter 1 of this embodiment, the lighter 1 is normally in the locked state where the side wheels 62 cannot be rotated in the normal manner, which can be recognized by the user. That is, the lighter 1 of this embodiment cannot be ignited unless the side wheels 62 are depressed downward. Since the ignition lock can be released by simply depressing downward the side wheels 62, even the large-handed person can easily use the lighter 1. Further since the lighter 1 automatically returns in response to the end of use to the locked state where the lighter 1 cannot be ignited in the normal manner, reliability of the ignition lock is improved.

Further, the lighter 1 of this embodiment requires less additional and is less complicated in structure, which makes the lighter more suitable for mass production.

Though, in the embodiment described above, the side wheel 62 is provided with a pair of engagement projections 62*a* spaced at about 180°, the side wheel 62 may be provided with three engagement projections 62*a* substantially at regular intervals of about 120°. Also in this case, the periphery of the side wheel 62 is provided with knurled finger-application portions 62*b* and 62*c* on front and rear sides of each engagement projection 62*a* in the direction of rotation of the side wheel 62 with the part of the periphery of the side wheel 62 between the finger-application portion 62*b* formed on the front side of an engagement projection 62*a* and the finger-application portion 62*c* formed on the rear side of another engagement projection 62*a* is left smooth to form a smooth portion 62*d* so that the side wheels 62 are rotated by about 120° in response to movement of the finger from the engagement projection 62*a* of the side wheel 62 in engagement with the engagement portion 85 of the cap 8 to the depressing portion 52 of the actuator lever 5.

Second Embodiment

Figure 6:
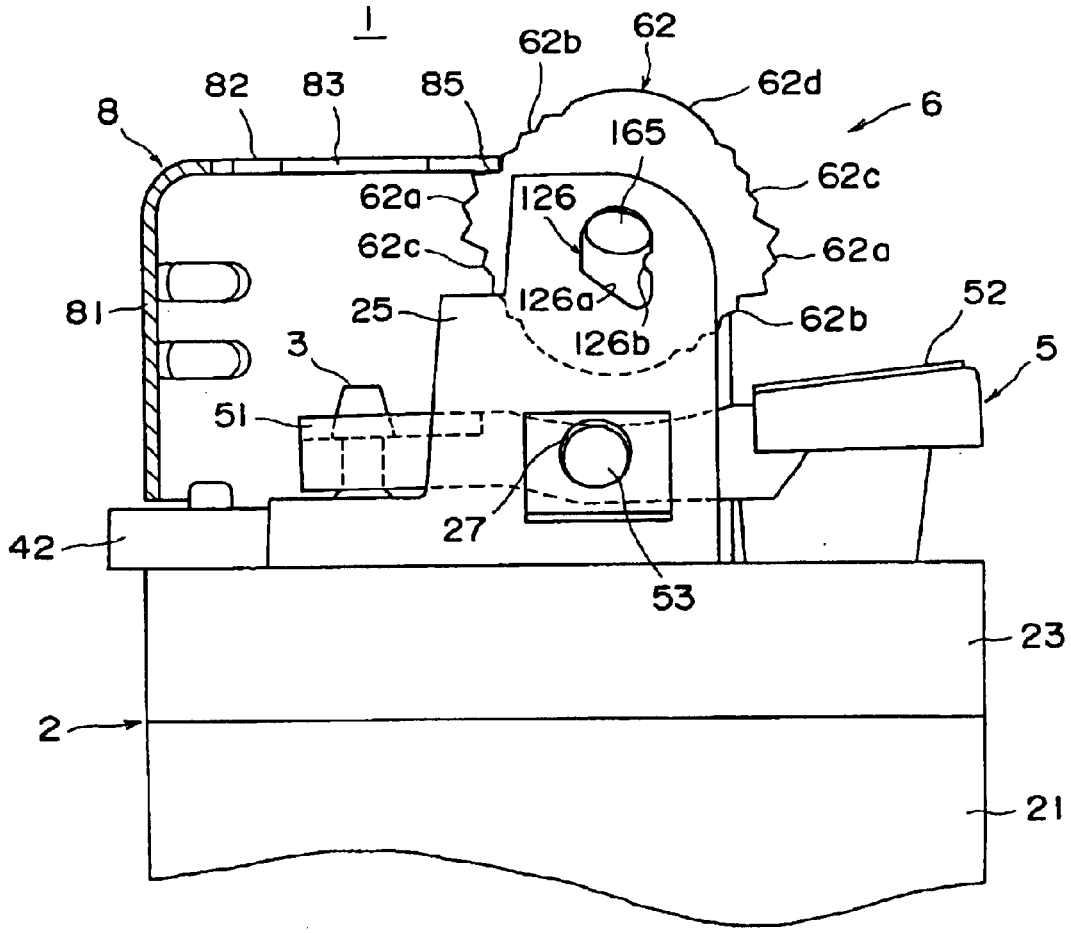
FIG. 6 is a fragmentary front view showing an important part of a gas lighter in accordance with a second embodiment of the present invention with the cap shown in cross-section.
Figure 7A:
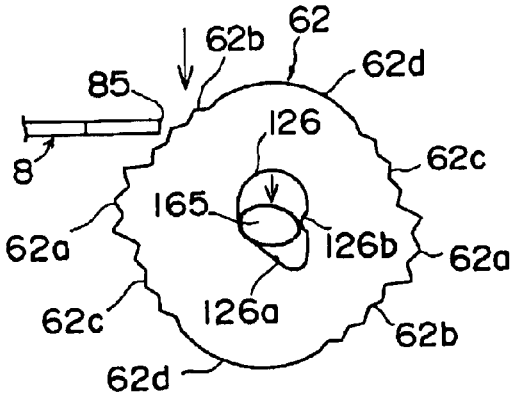
FIGS. 7A to 7F are views for illustrating different states of the side wheel during rotation for igniting the gas lighter of the second embodiment.
Figure 7B:
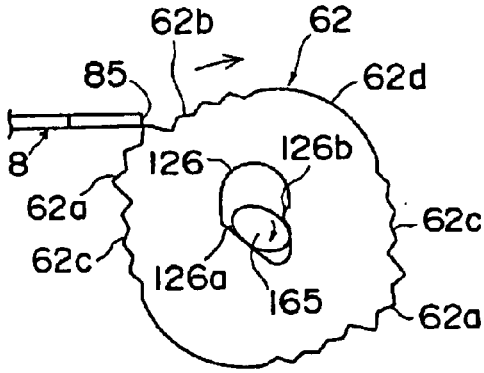

FIG. 6 is a fragmentary front view showing an important part of a gas lighter in accordance with a second embodiment of the present invention and FIGS. 7A to 7B are views for illustrating different states of the side wheel during rotation for igniting the gas lighter of the second embodiment.

The gas lighter 1 of this embodiment is different from that of the first embodiment in the shape of the rotary shaft 165 of the side wheels 62 and the bearing hole 126 formed in each of the support columns 25 is substantially the same as that of the first embodiment in the basic structure of the lighter body 2, the nozzle 3, the fuel supply means 4, the actuator lever 5, the ignition means 6, and accordingly, the elements analogous to those in the first embodiment are given the same reference numerals and will be described here.

As in the first embodiment, the side wheels 62 of the ignition means 6 are fixed to opposite sides of the file wheel 61 to be integrally rotated therewith and the flint 64 is pressed against the lower surface of the file wheel 61 under the force of the spring 63. The side wheels 62 are supported for rotation about a rotary shaft 165 which is elliptical in cross-section. An elongated bearing hole 126 is formed in an upper portion of each of the left and right support columns 25 of the intermediate casing 23 to be long in the vertical direction, and the opposite end portions of the rotary shaft 165 of the side wheels 62 are inserted into the respective bearing holes 126 so that the side wheels 62 and the file wheel 61 are rotatable and movable in a direction perpendicular to the rotary shaft 165 in which the flint 64 is pushed into the tubular portion 24.

Figure 7C:
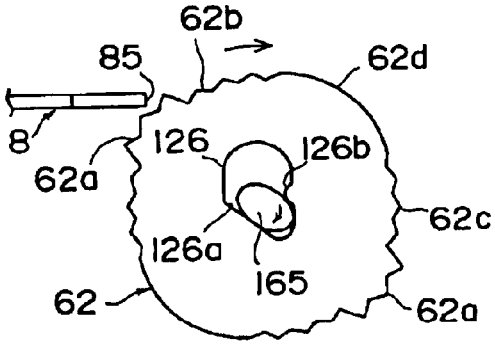

Further, the bearing hole 126 has an arcuate upper portion having a width equivalent to the major axis of the ellipse of the cross-section of the rotary shaft 165, front and rear side edges extending downward from opposite ends of the arcuate upper portion and a slant bottom 126*a* inclined downward rearward so that the bottom is higher in the front than the rear, and projection 126 projects inward from the rear side edge of the bearing hole 126 substantially at the middle thereof. The projection 126 is brought into contact with the rotary shaft 165 of the side wheels 62 when the rotary shaft 165 is depressed to resist downward movement of the rotary shaft 165. The projection 126 and the rotary shaft 165 are shaped so that the rotary shaft 165 is moved to its lowermost position with the major axis of the ellipse directed substantially in parallel to the slant bottom 126*a* as shown in FIG. 7C.

As in the first embodiment, each of the side wheels 62 is provided with a pair of engagement projections 62*a* to project radially outward from the periphery of the side wheel 62 in positions spaced from each other by about 180°. Each of the engagement projections 62*a* is brought into engagement with the engagement portion 85 on the top wall portion 82 of the cap 8 to prevent rotation of the side wheels 62 in the igniting direction. The periphery of the side wheel 62 is further provided with knurled finger-application portions 62*b* and 62*c* on front and rear sides of each engagement projection 62*a* in the direction of rotation of the side wheel 62. The part of the periphery of the side wheel 62 between the finger-application portion 62*b* formed on the front side of an engagement projection 62*a* and the finger-application portion 62*c* formed on the rear side of the other engagement projection 62*a* is left smooth to form a smooth portion 62*d*. In this embodiment, the radius of curvature of the outer peripheral surface of the smooth portion 62*d* is smaller than the radius of a circle with its center on the center of the rotary shaft 165 so that the central portion of the outer peripheral surface of the smooth portion 62*d* projects outward beyond an arcuate surface with its center on the center of the rotary shaft 165. The ellipse in cross-section of the rotary shaft 165 is arranged so that its major axis coincides with the centerline joining the two engagement projections 62*a* on the side wheel 62 and the front and rear vertexes of the ellipsoid on opposite ends of the major axis are directed to the respective engagement projections 62*a*.

Operation of the gas lighter of this embodiment will be described, hereinbelow. In the unused state shown in FIG. 6, the rotary shaft 165 of the side wheels 62 are in its uppermost position with the major axis of the ellipsoid directed back and forth and one of the engagement projections 62*a* on the periphery of the side wall 62 in the lifted position is in engagement with the engagement portion 85 on the lower surface of the end portion of the cap 8 and the side wheels 62 cannot be rotated in the igniting direction. That is, the lighter 1 cannot be ignited by rotation of the file wheel 61 in this state, whereby that the gas lighter 1 cannot be used in the known manner can be recognized by the user.

The igniting action of this gas lighter 1 includes depression of the finger-application portion 62*b* in the vicinity of the end of the cap 8 overcoming the force of the spring 63 as shown in FIG. 7A. The rotary shaft 165 is moved downward keeping its attitude with the rear vertex of the ellipsoid forced to pass the projection 126*b* and the front vertex of the ellipsoid comes to be in contact with the upper portion of the slant bottom 126*a*. As the side wheels 62 are moved downward, the engagement projection 62*a* is moved downward away from the engagement portion 85 of the cap 8.

Figure 7D:
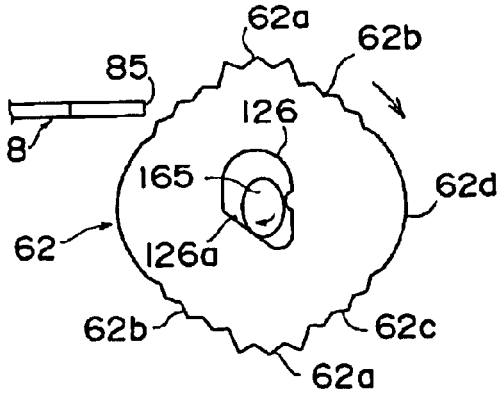

When the side wheels 62 are subsequently started to be rotated, the rotary shaft 165 is rotated in a direction in which the major axis of the ellipsoid becomes parallel to the slant bottom 126*a* with the rear vertex slid downward on the rear side edge of the bearing hole 126 as shown in FIG. 7B, whereby the rotary shaft 165 is moved rearward downward along the slant bottom 126*a* and the lighter 1 is brought to the lock-released state where the engagement projection 62*a* of the side wheel 62 does not interfere with the engagement portion 85 of the cap 8 and rotation of the side wheels 62 is allowed. When the side wheels 62 are further rotated, the major axis becomes parallel to the slant bottom 126*a* and the rotary shaft 165 is further moved rearward downward along the slant bottom 126*a* to the lowermost position. As the side wheels 62 are further rotated, the engagement projection 62*a* is brought to the upper position passing below the engagement portion 85 of the cap 8 and the rotary shaft 165 is rotated so that the major axis is erected with the lower vertex in contact with the slant bottom 126*a* as shown in FIG. 7D.

Figure 7E:
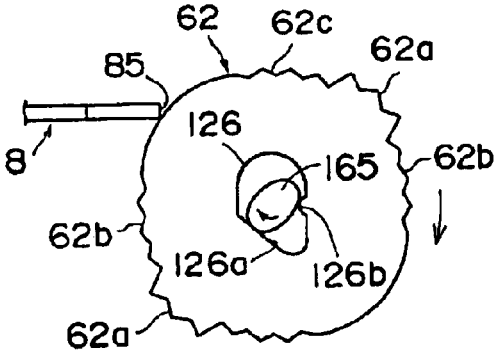
Figure 7F:
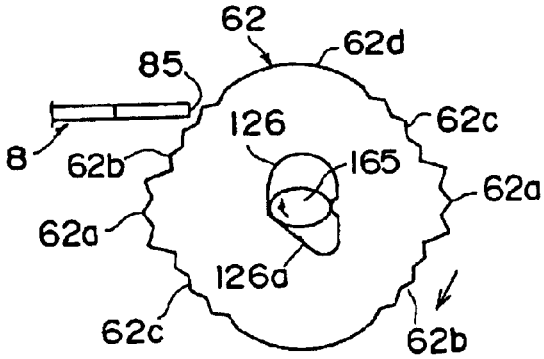

As the state the side wheels 62 are rotated by another 90° is shown in FIG. 7E, as the side wheels 62 are further rotated, the lower vertex is slid upward on the slant bottom 126*a*, whereby the side wheels 62 and the rotary shaft 165 are moved upward. When the side wheels 62 are further rotated until the major axis of the ellipsoid becomes horizontal as shown in FIG. 7F, the lower vertex is slid on the slant bottom 126*a* to the upper end thereof while the side wheels 62 are moved upward.

When the side wheels 62 are rotated by 90° or more in the course of the rotation of the side wheels 62, the finger is transferred from the side wheels 62 to the depressing portion 52 of the actuator lever 5. Then when the depressing portion 52 is depressed downward by the finger, the actuator lever 5 is rotated about the support shafts 53 and lifts the nozzle 3, whereby fuel gas ejected through the nozzle 3 is ignited by a spark generated by rotation of the file wheel 61. When the side wheels 62 are released from the finger, the side wheels 62 are lifted under the force of the spring 63 and at the final stage where the rotary shaft 165 returns to the upper portion of the bearing hole 126, the side wheels 62 is in the position shown in FIG. 6, where another engagement portion 62*a* is engaged with the engagement portion 85. Thus the lighter 1 is automatically returned to the locked state. Even if the wheels 62 is rotated largely overshooting the position shown in FIG. 7F under inertia, another engagement projection 62*a* is brought into engagement with the engagement portion 85 since the side wheels 62 have been already lifted, whereby the side wheels 62 cannot be rotated over the lock position shown in FIG. 6.

The smooth portions 62 on the side wheel 62 are the same in function as those in the first embodiment. That is, the side wheels 62 cannot be rotated unless the finger is applied to one of the finger-application portions.

In the gas lighter of this embodiment, since the rotary shaft 165 of the side wheels 62 is elliptical in cross-section and the bearing hole 126 has a slant bottom 126*a* so that the side wheels 62 are moved upward in response to rotation thereof during the igniting action, the side wheels 62 are prevented from being rotated over the lock position where one of the engagement projections 62*a* is engaged with the engagement portion 85 of the cap 8, whereby the lighter can be surely locked each time the lighter is ignited. Further, since the projection 126*b* is provided in the bearing hole 126 to resist the rotary shaft 165 of the side wheel 62 being moved in the direction in which the flint 64 is pushed downward, a strong force is required to move the side wheel 62 in the direction in which the flint 64 is pushed downward, and accordingly, the gas lighter is locked not to be ignited by the normal igniting action even after the flint 64 is consumed and the force to urge upward the side wheels 62 is weakened.

Though, in the embodiments described above, the direction of movement of the side wheels 62, that is, the direction of the bearing holes 126, is vertical, it may be inclined so long as the flint 64 can be urged downward in response to the movement of the side wheels 62. Further, the embodiments described above may be variously modified so long as the engagement projection 62*a* of the side wheel 62 can be disengaged from the engagement portion 85 on the cap 8 in response to movement of the rotary shaft of the side wheels along the bearing holes and the side wheels can be returned to the original position where the engagement projection 62*a* of the side wheel 62 is engaged with the engagement portion 85 on the cap 8. Further, though, in the embodiments described above, a flat rear end portion of the top wall portion 82 of the cap 8 is used as the engagement portion 85, the read end portion of the top wall portion 82 of the cap 8 may be bent to form an engagement portion 85. In this case, by forming the finger-application portions 62*b* so that one of them is partly exposed upward when one of the engagement projections 62*a* on the side wheel 62 is in engagement with the engagement portion 85 formed by the bent rear end portion of the top wall portion 82 of the cap 8, the same function as in the above embodiments can be obtained.

What is claimed is:

1. A gas lighter comprising a lighter body in which fuel gas is stored, a fuel supply mechanism which supplies the fuel gas in the lighter body to a nozzle by way of a valve mechanism, an actuator lever which is provided with a nozzle engagement portion to be engaged with the nozzle to cause the nozzle to eject the fuel gas in response to depression of a depressing portion, an ignition means comprising a file wheel provided with a side wheel on each side thereof and a flint pressed against the file wheel to generate a spark upon rotation of the file wheel and to ignite the fuel gas generated through the nozzle, and a cap mounted on an upper portion of the lighter body, wherein the improvement comprises that the side wheel and the file wheel are supported on a support column so that their axes of rotation are rotatable and movable in a direction in which the flint is retracted, and an engagement projection is provided on the periphery of the side wheel so the that engagement projection on the periphery of the side wheel is engaged with an engagement portion provided on the cap to prevent rotation of the file wheel, thereby locking the lighter not to be ignited, and is disengaged from the engagement portion upon movement of the side wheel in the direction in which the flint is retracted, thereby allowing the side wheel to rotate and releasing lock of the lighter, wherein the side wheels are mounted on a rotary shaft which is elliptical in cross-section and is supported by a bearing hole provided in a support column which is provided on the lighter body to extend vertically and is provided with a slant surface in a lower portion thereof so that the rotary shaft of the side wheel is rotatable and movable in a direction in which the flint is retracted, and is moved upward upon rotation thereof.

2. The gas lighter claim 1 wherein a projection is provided in the bearing hole to resist the rotary shaft of the side wheel being moved in the direction in which the flint is retracted.

3. A gas lighter comprising a lighter body in which fuel gas is stored, a fuel supply mechanism which supplies the fuel gas in the lighter body to a nozzle by way of a valve mechanism, an actuator lever which is provided with a nozzle engagement portion to be engaged with the nozzle to cause the nozzle to eject the fuel gas in response to depression of a depressing portion, an ignition means comprising a file wheel provided with a side wheel on each side thereof and a flint pressed against the file wheel to generate a spark upon rotation of the file wheel and to ignite the fuel gas generated through the nozzle, and a cap mounted on an upper portion of the lighter body, wherein the improvement comprises that the side wheel and the file wheel are supported on a support column so that their axes of rotation are rotatable and movable in a direction in which the flint is retracted, and an engagement projection is provided on the periphery of the side wheel so the that engagement projection on the periphery of the side wheel is engaged with an engagement portion provided on the cap to prevent rotation of the file wheel, thereby locking the lighter not to be ignited, and is disengaged from the engagement portion upon movement of the side wheel in the direction in which the flint is retracted, thereby allowing the side wheel to rotate and releasing lock of the lighter, wherein the engagement portion is provided on the periphery of the side wheel in a plurality of positions substantially at regular intervals and the periphery of the side wheel is provided with a knurled finger-application portion at least forward of each engagement projection in the direction in which the side wheel is rotated upon ignition with the remaining part of the periphery of the side wheel is left smooth.

4. The gas lighter according to claim 3 wherein the side wheel is provided with a pair of engagement projections.

* * * * *